US009153214B2

(12) United States Patent
Korfker

(10) Patent No.: US 9,153,214 B2
(45) Date of Patent: Oct. 6, 2015

(54) SHOULDER REST

(71) Applicant: Gustav Pirazzi & Comp. KG, Offenbach (DE)

(72) Inventor: Berent Korfker, London (GB)

(73) Assignee: GUSTAV PIRAZZI & COMP. KG, Offenbach (DE)

( * ) Notice: Subject to any disclaimer, the term of this patent is extended or adjusted under 35 U.S.C. 154(b) by 21 days.

(21) Appl. No.: 14/043,448

(22) Filed: Oct. 1, 2013

(65) Prior Publication Data

US 2014/0090539 A1 Apr. 3, 2014

(30) Foreign Application Priority Data

Oct. 2, 2012 (EP) ..... 12006861

(51) Int. Cl.
*G10D 3/18* (2006.01)

(52) U.S. Cl.
CPC ..... *G10D 3/18* (2013.01)

(58) Field of Classification Search
CPC ..... G10D 3/18; G10D 3/00; G10D 1/005; G10D 1/02; G10G 5/00
USPC ..... 84/279, 280
See application file for complete search history.

(56) References Cited

U.S. PATENT DOCUMENTS

| | | | | |
|---|---|---|---|---|
| 4,062,695 | A | 12/1977 | Pieck | |
| 5,275,078 | A | 1/1994 | Wolf | |
| 6,291,750 | B1 | 9/2001 | Farha | |
| 7,265,284 | B2 | 9/2007 | Muir et al. | |
| 7,488,877 | B2 | 2/2009 | Cheng et al. | |
| 8,492,629 | B2 * | 7/2013 | Johnson | 84/280 |
| 8,704,065 | B2 * | 4/2014 | Korfker | 84/280 |
| 2009/0205478 | A1 * | 8/2009 | Osuga et al. | 84/433 |
| 2013/0125728 | A1 | 5/2013 | Korfker | |
| 2013/0276611 | A1 | 10/2013 | Vochezer | |

FOREIGN PATENT DOCUMENTS

| | | | |
|---|---|---|---|
| CZ | 22 928 | U1 | 11/2011 |
| DE | 100 07 834 | | 8/2000 |
| EP | 0 507 994 | | 10/1992 |
| EP | 2 002 759 | | 12/2008 |
| GB | 2 052 828 | A | 1/1981 |
| WO | WO 2011/098248 | A2 | 8/2011 |
| WO | WO 2012/080342 | A1 | 6/2012 |

* cited by examiner

*Primary Examiner* — Kimberly Lockett
(74) *Attorney, Agent, or Firm* — Henry M. Feiereisen LLC

(57) ABSTRACT

A shoulder rest for a stringed instrument includes a resting element configured to rest on a shoulder or chest of a player. The resting element has a base which is made of compressed wood. The base of the resting element is formed by a workpiece cut from a block of compressed wood having a cross direction which is substantially normal to a fiber orientation of the block of compressed wood.

19 Claims, 7 Drawing Sheets

SHOULDER REST

CROSS-REFERENCES TO RELATED APPLICATIONS

This application claims the priority of European Patent Application, Serial No. 12006861.4, filed Oct. 2, 2012, pursuant to 35 U.S.C. 119(a)-(d), the disclosure of which is incorporated herein by reference in its entirety as if fully set forth herein.

BACKGROUND OF THE INVENTION

The present invention relates to a shoulder rest for a stringed instrument, and more particularly to a shoulder rest for a violin or viola.

The following discussion of related art is provided to assist the reader in understanding the advantages of the invention, and is not to be construed as an admission that this related art is prior art to this invention.

Stringed instruments, in particular violins and violas, are held when played at their body end between the musician's chin and shoulder. As, however, the distance between the head and the shoulder region of the player is as a rule larger than the thickness of the instrument, the musician can hold or clamp the instrument only in a very uncomfortable posture, so that—if it is at all possible to play the instrument—impairments of the playing quality are inevitable. To counteract this, so-called chin rests and shoulder rests were developed for violins and violas.

These shoulder rests are detachably fixed on the body of the instrument by means of a holding device, thus serving for making it more comfortable for the musician to hold the instrument. In general, a shoulder rest is fixed on a violin or the like, forming a supporting area resting on the musician's shoulder, the instrument itself being supported on a chosen level. The latter depends in particular on the structure of the body, in particular of the length of the neck, the shape of the shoulder, and the position of the violin, of the musician. Such shoulder rests are known, for example, from EP 507 994 61, U.S. Pat. No. 4,062,695, DE 100 07 834 A1, U.S. Pat. No. 7,266,284, or U.S. Pat. No. 7,488,877 B2.

The shoulder rests can be configured with a solid bottom. As a rule, however, this bottom is only inadequately shaped in accordance with the musician's shoulder and thus adapted in an individualized manner, so that usually, a certain loss of playing comfort and convenience has to be accepted. For reasons of comfort, however, the underside of the solid bottom can also be provided with a cushion which is in contact with the musician's shoulder when the instrument is played. Holding or carrying elements protruding upwards and carrying pivotable fork-shaped end pieces are fixed on the two ends of the bottom. These end pieces can be fastened on the side walls of the instrument body near the back of the body. To make it possible to fasten this type of shoulder rest firmly on the instrument, the bottom of the shoulder rest possesses a certain self-elasticity, which serves for generating a certain clamping force with which the fork-shaped end pieces grip the instrument. End pieces are known in other configurations, too, in combination with the carrier elements, most of which, however, grip the instrument with a certain clamping effect.

For a high tonal quality and great harmony with the instrument, such shoulder rests are usually made of a plastic or synthetic material, more recently, however, also of wood or based on wood, and their contour is adapted, at least approximately, in an individualized manner to the shape of the players body. In this way, it shall be achieved, among others, that the player can play the instrument in a particularly comfortable and harmonious way and without impairment of his/her concentration or attention.

A particularly individualized shape and contouring of the shoulder rest, adapted to a player's personal requirements and preferences, is, however, as a rule, not possible at all or possible only with considerable expenditure and with recourse to special resources, such as, for example, machines or the like. With such an individualized shaping, one must, furthermore, always also bear in mind that the tonal quality of the instrument should not be impaired by the mounted shoulder rest or should be impaired to an, acceptable extent only. It is exactly for the combination of these design targets that up to now, at best moderate results have been achieved.

It, would therefore be desirable and advantageous to provide an improved shoulder rest which obviates prior art shortcomings and is shaped to best suit a user in a particularly simple manner and realizable by the user himself/herself to thereby allow implementation of particularly high playing quality without adversely affecting the tonal quality of the instrument.

SUMMARY OF THE INVENTION

According to one aspect of the present invention, a shoulder rest for a stringed instrument includes a resting element configured to rest on a shoulder or chest of a player, said resting element having a base made of compressed wood.

Manufacture and some properties of compressed wood are known, for example, from EP 2 002 759 A1, the disclosure of which with respect to definition and the manufacturing process of compressed wood is explicitly incorporated herein by reference.

In particular, during the manufacture of compressed wood, a most carefully selected starting wooden body, having a moisture content of approx. 50 to 60%, is first of all dried down to a moisture content of approx. 30% under natural ambient conditions, then cut and smoothed and further dried to a moisture content of approx. 20%. Afterwards, it can be subjected to the actual compression process.

For this purpose, i.e. during actual compression, the wooden block to be treated is first of all subjected to a thermal treatment, in particular in order to soften it appropriately. Then, the wooden block pretreated in this way is subjected to a hydrostatic pressure in the compression chamber properly speaking. This effects a compression of the wood fibers in the direction of the fibers, so that the fiber walls are folded. In this way, the overall shape of the wood is made bendable and formable.

Immediately after the compression, the treated wood may show a distortion or deformation of the wooden block as a whole, on account of the treatment. To compensate that, a subsequent bending or forming operation may be carried out in order to restore the favorable straight-lined shape of the wooden block for its further processing.

The invention is based on the consideration that especially in case of high demands and expectations regarding the tonal quality and playing behavior of the unity of the instrument on the one hand and the shoulder rest on the other hand, the contour of the resting element of the shoulder rest should be adapted to the player's shoulder or chest. In order to additionally enable, however, a subsequent improvement of the shape of the shoulder rest in the manner of a gradual adaptation to the user's body shape for possibly necessary improvements or optimations of the contouring, with reasonable expenditure, it should in general be possible that the user modifies the shape himself/herself, i.e. in particular without having recourse to accordingly specialized personnel or corresponding tools or infrastructure. For this purpose, the resting element of the shoulder rest should be manufactured from a suitable chosen, subsequently deformable material.

It has turned out most surprisingly that compressed wood, in particular if manufactured by the above-described process, is particularly well suited for that purpose, because, on the one hand, the use of compressed wood enables a particularly easy, and even subsequent, adaptation of the shape by the user himself/herself, namely through bending, due to its bendability and formability, whereby the final shape defined by the user can subsequently be fixed by means of a following process of thermal treatment, for example in a microwave oven. This fixation can subsequently be canceled completely or in part through a suitable treatment, in particular by increasing the moisture and possibly another process of thermal treatment, so that it is possible to deform the resting element anew and correct its shape. On the other hand, however, compressed wood is particularly suitable for the intended use in a shoulder rest with regard to its acoustic or tonal properties, because its vibrational behavior seems to be particularly well compatible with the vibrational behavior of the body of the instrument.

A base whose material properties are specifically adapted to the desired properties regarding bendability on the one hand and tonal quality on the other hand is particularly suitable especially for use in the resting element of a shoulder rest. Advantageously, the compressed wood forming the base can have a mean compression of approx. 15% to approx. 25%, particularly preferably of approx. 17% to approx. 20%. By "compression", one understands in this case the length reduction caused by the manufacture, referred to the original length of the untreated wood. In this connection, it has to be taken into account that typically, the compression is not uniform, but varies for each treated wooden block within a range of approx. +/−2% around the mean compression. That means that a wooden block with a mean compression of 17% shows compression values of 15 to 19%.

In order to guarantee, furthermore, particularly high qualities of the resting element in view of tone and, thus, to guarantee particularly good properties for the unity of instrument and shoulder rest, the wood (preferably maple wood) to be used for forming the base has advantageously a density of approx. 0.5 to approx. 0.8 g/cm$^3$, preferably of approx. 0.6 g/cm$^3$, prior to being compressed. After compression, the compressed wood forming the base has advantageously a density of approx. 0.6 to approx. 0.96 g/cm$^3$, preferably of approx. 0.72 g/cm$^3$. It is exactly by specifying a material with a density in this range that the vibrational behavior of the material and, thus, of the resting element is approximately comparable to that of relatively hard wood, used, for example, also for the body of a violin, in particular the back of the violin, so that particularly advantageous sound-conduction and tonal properties can be obtained. In order to improve them even further, maple wood, preferably with its dried density, is provided as compressed wood in a particularly advantageous embodiment. This wood presents a high mechanical load-bearing capacity and, at the same time, a particularly harmonious sound in combination with a violin.

It has, furthermore, turned out surprisingly that for a particularly advantageous combination of tonal properties on the one hand and comfortable and user-friendly (contour) properties on the other hand, the choice of suitable geometry parameters for the resting element of the shoulder rest is relevant. In a particularly advantageous embodiment, the cross-sectional area of the base of the resting element, referred to its longitudinal direction, should be at least 60 mm$^2$ (in particular when it is used as a support for a resting element and/or when hardened wood is used), preferably at least 75 mm$^2$, and at most 210 mm$^2$ (in particular with a thickness of 7 mm and a width of 3 cm), particularly preferably at most 150 mm$^2$. The cross-sectional area should in particular be approximately uniform and change only slightly along the longitudinal direction of the shoulder rest, because changes of the cross-sectional area seem to cause disturbances in the tonal behavior. Furthermore, it has turned out surprisingly, with regard to the tonal properties, that the tonal behavior is more saturated, but also less open and coarse in tone, if the material thickness is large (correspondingly large cross-sectional area).

If, however, there is less material present (correspondingly smaller cross-sectional area), a more open tonal behavior can be achieved, which, however, seems to become too hard if the material thickness is too small. In an advantageous embodiment, the resting element can have, therefore, a thickness of at least 2 mm and at most 7 mm, preferably of at least 3 mm and at most 6 mm, particularly preferably of at least 3.3 mm and at most 5 mm, auf.

In order to ensure a particularly high holding comfort and thus a particularly favorable playability under these marginal conditions, the width of the resting element may also advantageously be chosen in a suitable manner. Advantageously, the width of the resting element is at least 20 mm and at most 40 mm, particularly preferably at least 22 mm and at most 30 mm, preferably at least 24 mm and at most 28 mm.

It has turned out, as another particularly preferable dimensioning specification, that in view of sufficient stability and structural integrity, the material should have a thickness of at least 2.5 mm, preferably of approx. 3.5 mm, for a width of 25 mm (preferably when used as a support element in combination with a separate adapter piece), whereas, for a width of 28 mm, a thickness between 4.5 mm and 5.5 mm should be chosen. For an independent configuration of the shoulder rest, i.e. when it is used directly in combination with the instrument to be played, the following parameter combinations are particularly advantageous:

for a shoulder rest for a 3/4 violin: thickness 4 mm, length 205 mm, width 25 mm, mean compression 17 to 20%, for a shoulder rest for a 4/4 violin: thickness 4.5 mm, length 221 mm, width 25 mm, mean compression 17 to 20%, for a shoulder rest for a 4/4 viola: thickness 5 mm, length 274 mm, width 28 mm, mean compression 17 to 20%.

It also comes into consideration instead to use a shoulder rest in combination with an adapter piece, which shall make it possible to couple the shoulder rest to the instrument, keeping the impairment of the tonal qualities as low as possible. When such an adapter piece, known for example from DE 10 2007 038 004 A1, is used, the resting element has advantageously a minimum cross-section of 60 mm$^2$, preferably a cross-section of at least 75 mm$^2$. In particular, the base of the resting element advantageously presents the following parameter combination: thickness 3.3 mm, length 205 mm, width 25 mm, mean compression 17%.

It has, furthermore, turned out most surprisingly that the orientation of the fibers of the compressed wood forming the base is relevant for the achievable tonal quality and harmony of the shoulder rest in combination with the instrument properly speaking. Advantageously, the base of the resting element can be formed by a workpiece cut from a block of compressed wood whose cross direction is substantially normal to an orientation of the fibers of the block of compressed wood associated with a growth ring. This results preferably in an orientation in which the growth rings of the wood, running through the block of compressed wood, are arranged "upright", so that their area normal lies in the base plane of the resting element.

A considerable improvement of the tonal properties of the unity of instrument and shoulder rest can be achieved by providing the resting element of the shoulder rest, in a particularly advantageous embodiment, with a plurality of holes. Thanks to such an embodiment of the resting element, which has an independent inventive significance and offers a considerable improvement of the tonal qualities when using the shoulder rest, even independently of the choice of material, but which is also advantageous especially in combination with the just specified choice of material for the resting element, the vibrational behavior of the shoulder rest and the acoustic coupling to the vibrational behavior of the instrument is per se particularly favorable and disturbance-free, so that altogether a particularly high tonal quality can be achieved when playing the instrument.

Within the framework of this configuration, which is considered as independently inventive, the base of the resting element can be provided with a plurality of holes forming a specifically combined unity of main holes and secondary holes which in their entirety are dimensioned and positioned for a particularly favorable sound conduction within the base. A number of main holes are arranged centrally in the resting element, in relation to the width thereof, and a number of secondary holes are arranged eccentrically in the resting element, also in relation to the width thereof, and in each case approximately in the middle between two adjacent main holes, viewed in the longitudinal direction of the resting element. Through this positioning of the holes, it is in particular possible to take into account a number of actually diverging design targets: on the one hand, a particularly favorable guidance of sound in the resting element, is possible and, on the other hand, the structural integrity of the resting element itself can be maintained particularly stable, in view of the weakening caused by the holes.

For a particularly harmonious vibrational behavior, the diameter or area of the holes is advantageously chosen of equal size, advantageously for one or both of these categories, i.e. main holes on the one hand and/or secondary holes on the other hand. It has, furthermore, turned out surprisingly that a particularly favorable vibrational behavior can be obtained when the hole area of the individual main holes amounts to approximately four times the hole area of the individual secondary holes, that means that the hole size, defined for example by the inside width of a hole, of the main holes is approximately double the hole size of the secondary holes.

An embodiment in which two secondary holes each are provided, which are arranged eccentrically between two successive main holes, viewed in the longitudinal direction of the resting element, and which are preferably positioned mirror-symmetrically to the bisecting line of the resting element, is particularly preferable. In such an arrangement, the aforementioned choice of geometry, wherein the hole size of the main holes is approximately double the hole size of the secondary holes, results in the fact that the cross-sectional share filled by the wooden material in the region of the main holes, viewed over the width of the resting element, is approximately equal to that in the region of the secondary holes, which leads to particularly good sound-conduction properties, viewed in the longitudinal direction of the resting element. It can in particular be achieved in this way that the sound spectrum and the tone of the instrument have a high-quality and open effect, with the resting element remaining at the same time particularly well bendable.

It has, furthermore, turned out most surprisingly that a particularly high tonal quality of the unity of instrument and shoulder rest can be achieved by the holes advantageously taking up altogether an area of at least 8%, preferably of at least 10%, and at most 30%, preferably of at most 20%, of the area of the resting element. Particularly preferably, the holes take up altogether an area of approx. 12.5% of the area of the resting element. In an alternative or additional advantageous development, the holes have sharp edges. In comparison with holes with rounded edges, a particularly pleasant sound pattern is achieved in this way.

A particularly harmonious and high-quality sound pattern can, furthermore, be achieved by contouring the holes, or at least some of them, in a particularly suitable manner. It is in particular provided to configure the holes with a non-round contour, some or all holes advantageously presenting an elongated shape, viewed in the longitudinal direction of the resting element, so that each of them presents a larger inside width, viewed in the longitudinal direction of the resting element, than in the latter's cross direction. This configuration enables a particularly suitable guidance of sound within the resting element, in which the sound waves are guided around the holes, which are considered as obstacles for sound propagation, in a particularly suitable and harmonious manner. The configuration of the holes extending in longitudinal direction can be combined in particular with a relatively pointed contour in the region where the sound waves impact, so that the sound waves can be guided around the holes in a particularly disturbance-free and loss-free manner.

According to another particularly advantageous feature of the present invention, the contour of the main holes comprises a number of almost straight-lined, relatively slightly bent contour segments. In this way, the holes can have a basic shape which is, for example, substantially diamond or "eye"-shaped and which—viewed in the longitudinal direction of the resting element—tapers relatively acutely (apart from roundings) at their front and rear sides and presents on each of their lateral edges a certain uniform, though relatively slight, bending. In this way, one can achieve, on the one hand, a particularly good redirecting function for the sound waves arriving in longitudinal direction, while, on the other hand, the material forming the resting element presents only a relatively slight weakening in the immediate environment of the holes, so that the tensions arising in the material in the environment of the holes by a subsequent bending of the formed piece in the environment of the holes are distributed over the surroundings of the respective hole in a particularly favorable manner. This keeps the risk of a possible formation of cracks in the surroundings of the holes particularly low.

It is, furthermore, surprisingly favorable for the sound pattern if advantageously an odd total number of main holes, preferably five, are provided.

The advantages achieved with the invention reside in particular in that the manufacture of the base of the resting element of the shoulder rest from compressed wood enables a contouring which is individualized and adapted to the respective user to a particularly high degree and which can subsequently be modified and thus improved again or else be adapted to other users. This adaptation can be effected in a particularly simple manner by the user himself/herself, without requiring having recourse to specialized personnel or corresponding machines. By a suitable specification of the material parameters, such as, for example, density, and of the geometry parameters, such as, for example, thickness and width, one can, furthermore, achieve a particularly favorable acoustic behavior of the shoulder rest, which makes the latter particularly well suited especially for use with a violin.

In addition, the above-mentioned choice of material and the use of compressed wood in the shoulder rest of the stringed instrument, using a natural and environmentally friendly material, enable a particularly weight-saving lightweight construction of the shoulder rest.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
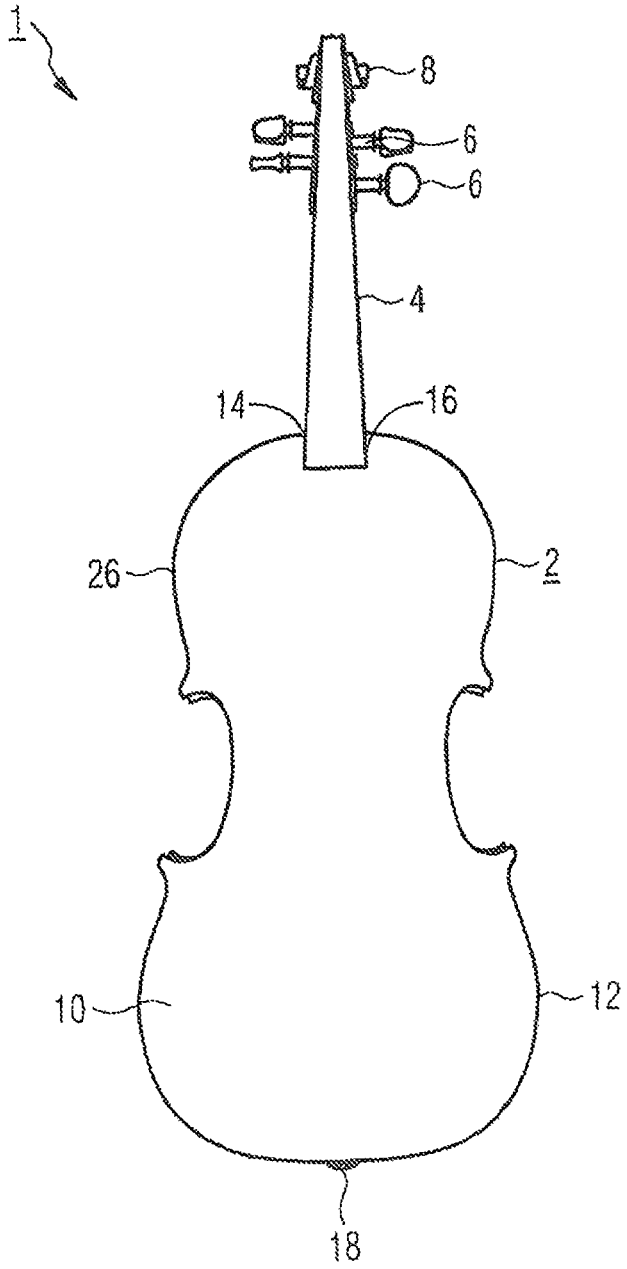
FIG. 1 is a bottom view of a classical violin.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a bottom view of a classical violin, generally designated by reference numeral 1 and including a body 2 forming the resonating body, a neck 4, on which a fingerboard is mounted, and a pegbox with tuning pegs 6, which ends in a scroll 8. The body 2 includes a body back 10 as well as a peripheral back edge 12. On the neck-side end 14 of the body 2, the neck 4 of the violin 1 is connected with the body 2 via the upper end block 16. Further blocks which serve for stabilizing the violin 1 are incorporated in the body 2.

At the lower end block 18, the strings of the violin 1 are screwed up with the help of a tailpiece located on the upper side of the violin 1. Therefore, the lower end block 18 is incorporated in the body 2 in a very stable and firm manner. The upper end block 16, which carries the neck 4 and the fingerboard, is also stably and firmly mounted in the body 2. Nowadays, the upper end block 16 and the neck 4 are in most cases manufactured separately and glued together, in order to given them the necessary holding properties as well as tonal and vibrational properties.

Side walls, so-called ribs 26, are placed on the sides of the body back 10 in the region of the peripheral back edge 12, and a body top is fixed on these ribs 26, opposite the body back. These parts essentially form the body 2 forming the resonating body of the violin 1 and are stabilized with the help of the so-called outer blocks and of the upper and lower end blocks 16, 18.

Figure 2:
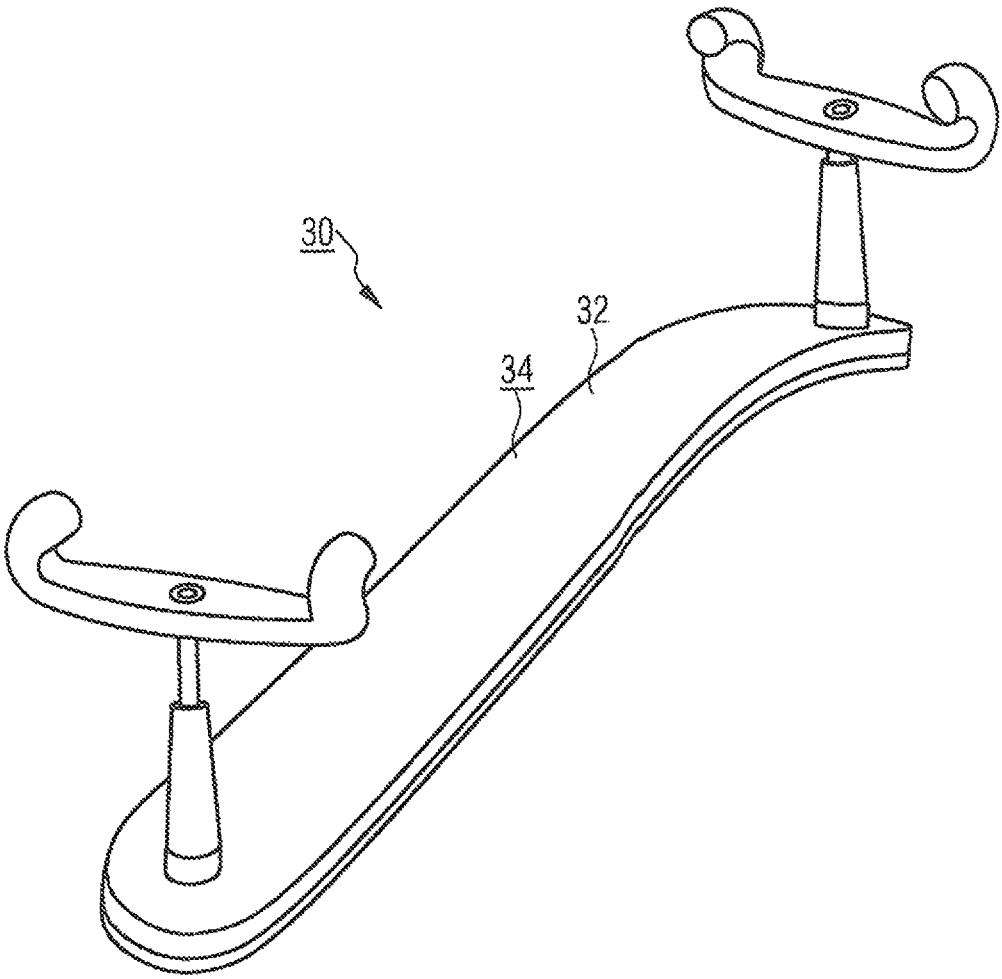
FIG. 2 is a perspective illustration of one embodiment of a shoulder rest according to the present invention for use with the violin of FIG. 1.
Figure 3:
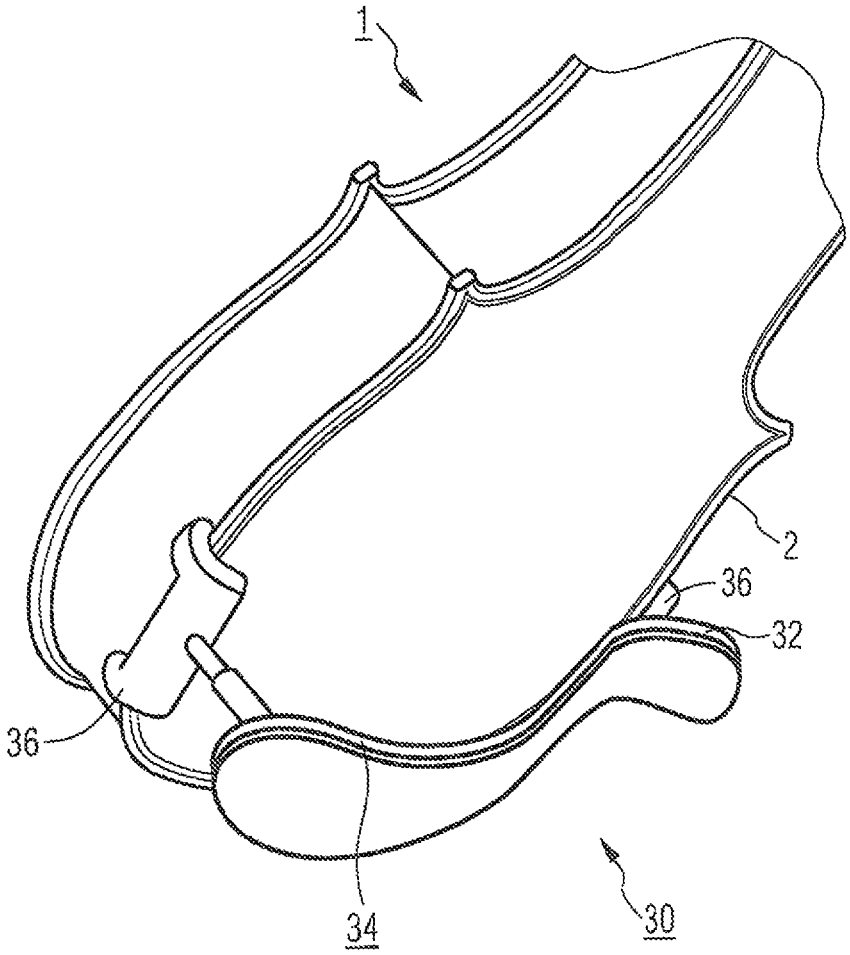
FIG. 3 is a perspective partial view of the violin with attached shoulder rest.

In order to enable a comfortable posture for the musician when playing the violin 1, maintaining, at the same time, a high tonal quality of the violin 1, a shoulder rest 30 is provided, as shown in FIG. 2 as a separate component and in FIG. 3, in mounted condition, fixed on the body 2 of the violin 1. The shoulder rest 30 comprises a resting element 32 provided for resting on the player's shoulder and/or chest, whose base 34 can be fixed on the body 2 of the violin 1 and in particular on the peripheral back edge 12, by clamping units 36 arranged on the end sides. In the exemplary embodiment, the shoulder rest 30 can, thus, be fixed directly on the body 2 of the violin 1 by the clamping units 36; alternatively, however, it could also be provided to additionally use an adapter piece between the shoulder rest 30 and the body 2.

For a particularly good playability and, at the same time, a high holding comfort, the resting element 32 of the shoulder rest 30 is contoured, whereby an individualized adaptation to the respective player is provided through the shaping or contouring of the resting element 32. In order to enable a particularly individualized shaping as well as an adaptation which can be effected by the user himself/herself, the base 34 of the resting element 32 of the shoulder rest 30 is manufactured from compressed wood.

During the manufacture of compressed wood, a most carefully selected starting wooden body, preferably having a moisture content of approx. 50 to 60%, is first of all dried down to a moisture content of approx. 30% under natural ambient conditions, then cut and smoothed and further dried to a moisture content of approx. 20%. After that, the starting wooden body prepared in this way can be subjected to the compression process properly speaking.

During the compression properly speaking, the wooden block to be treated is first of all subjected to a thermal treatment, in particular in order to soften it appropriately. Then, the wooden block pretreated in this way is subjected to a hydrostatic pressure in the compression chamber properly speaking. This effects a compression of the wood fibers in the direction of the fibers, so that the fiber walls are folded. In this way, the overall shape of the wood is made bendable and formable. For the intended use in the resting element 32 of the shoulder rest 30, the compression is carried out specifically in view of the desired bendability on the one hand and the desired tonal quality on the other hand. It has turned out surprisingly that for this purpose, the compressed wood should have a mean compression of preferably approx. 17% to approx. 20%, possibly even more. By "compression", one understands in this case the length reduction caused by the manufacture, referred to the original length of the untreated wood. In this connection, it has to be taken into account that typically, the compression is not uniform, but varies for each treated wooden block within a range of approx. +/−2% around the mean compression. That means that a wooden block with a mean compression of 17% shows compression values of 15 to 19%.

Immediately after the compression, the treated wood may show a distortion or deformation of the wooden block as a whole, on account of the treatment. To compensate that, a subsequent bending or forming operation may be carried out in order to restore the favorable straight-lined shape of the wooden block for its further processing. After that, the wooden block is a little seasoned to take into account any relaxation processes or the like.

Figure 4:
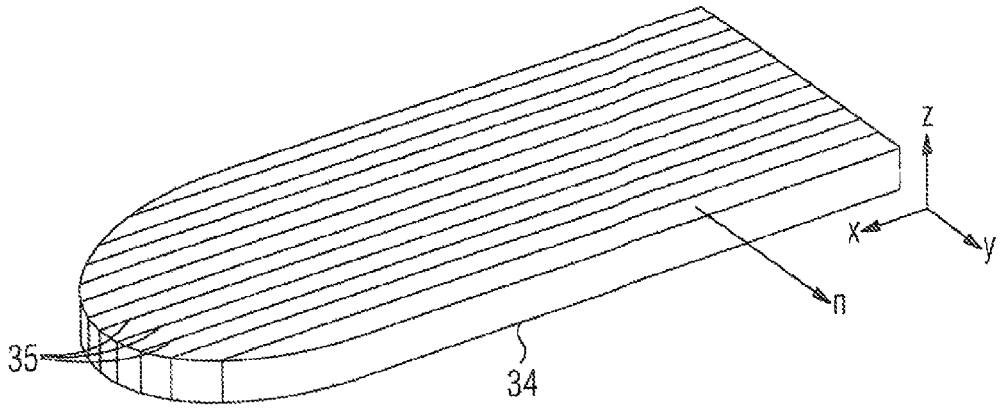
FIG. 4 is a detail of a partial view of a resting element of the shoulder rest of FIG. 2.

Then, a particularly well suited piece is selected and cut from the available compressed wood. Among others, the orientation of the fibers of the compressed wood intended to form the base 34 is taken into consideration. For manufacturing the base 34 of the resting element 32, one selects in particular a workpiece cut from a block of compressed wood whose cross direction is substantially oriented normal to the direction of the fibers of the block of compressed wood. This results in a particularly preferable orientation of the structure of the wood in relation to the geometry of the base 34, as can be seen, by way of example, in the detail of FIG. 4. It can be seen from this representation that the compressed wood in the base 34 is oriented such that its growth rings 35 are arranged "upright", i.e. their surfaces extend approximately in parallel to the z-axis of the base 34. Accordingly, the area normal of the growth rings 35 lies in the basal plane, defined by the longitudinal and cross directions x, y, of the base 34.

In order to ensure, furthermore, particularly high tonal qualities of the resting element 32 and, thus, particularly good properties for the unity of instrument and shoulder rest 30, compressed maple wood has been chosen in the exemplary embodiment as the compressed wood forming the base 34, which (after compression) has a density of approx. 0.72 $g/cm^3$. This corresponds to a density value before compression of approx. 0.6 $g/cm^3$.

After cutting, the corresponding workpiece is subjected to suitable intermediate operations, such as, for example, polishing and grinding. After that, a surface treatment can also be effected, for example to provide the base 34 with an optically attractive texture or the like. Preferably, a varnish can be used which, on the one hand, is elastic enough not to be damaged by the intended bending and, on the other hand, thermally stable enough for the intended subsequent thermal treatment.

Thanks to the bendability and formability of the compressed wood, the shape of the base 34 of the resting element 32 can then be contoured or adapted to the respective user in an individualized manner in a particularly simple way and even subsequently by the user himself/herself, namely by bending. The final shape defined by the user can in addition subsequently be fixed by means of a following process of thermal treatment, for example in a microwave oven. This fixation can also subsequently be canceled through a suitable treatment, in particular by increasing the moisture, so that it is possible to deform the resting element 32 anew and correct its shape. Preferably, a microwave power of approx. 900 W is set for, e.g., a treatment time of a few minutes (for example 4 to 5 min.), or a microwave power of approx. 450 W, for a treatment time of several minutes (for example 15 to 20 min.), the resting element being preferably placed on a dish during the thermal treatment.

For a particularly favorable combination of tonal properties on the one hand and comfortable and user-friendly (contour) properties on the other hand, the base 34 has in the exemplary embodiment in a configuration designed for a violin a cross-sectional area of approx. 112 $mm^2$.

Figure 5:
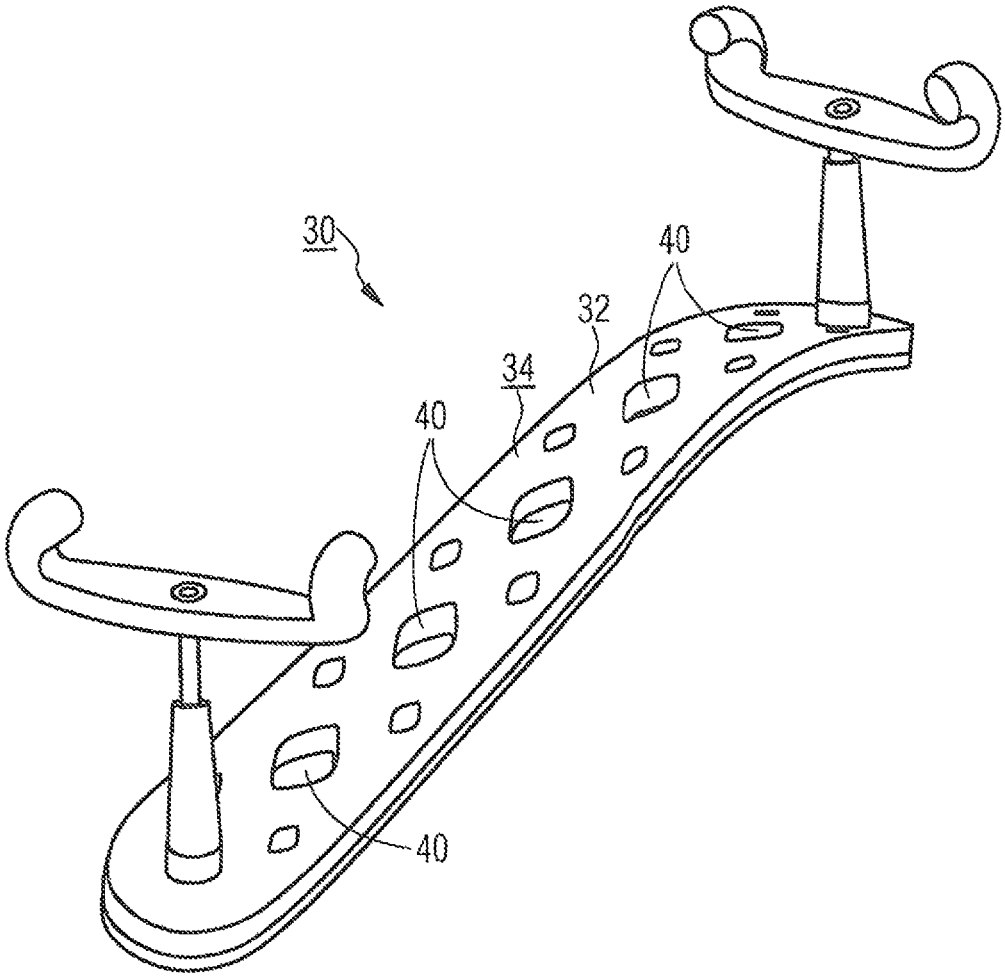
FIG. 5 is a perspective illustration of another embodiment of a shoulder rest according to the present invention.

FIG. 5 shows an alternative embodiment of a shoulder rest 38. Like with the shoulder rest 30 of FIG. 2, the base 34 of the resting element 32 is made of compressed wood. In addition, however, the resting element 32 of the exemplary embodiment according to FIG. 5 includes a plurality of holes 40, which considerably improve the vibrational behavior and thus the tonal behavior of the shoulder rest 38. The embodiment of the resting element 32 with these holes 40, described in the following, is considered as independently inventive, so that the base 34 of the resting element 32 of the shoulder rest 38 could also be manufactured from another suitably chosen material, in particular from "ordinary" wood.

The base 34 of the resting element 32 of the shoulder rest 38 is provided with a plurality of holes 40 forming a specifically combined unity of main holes 42 on the one hand and secondary holes 44 on the other hand. The holes 40 in their entirety are dimensioned and positioned for a particularly favorable sound conduction within the base 34. Altogether five main holes 42 are arranged centrally in the resting element 32, referred to the width thereof, and the secondary holes 44 are arranged in the resting element 32 eccentrically in pairs symmetrically to the middle thereof, also referred to the width thereof, and in each case approximately in the middle between two adjacent main holes 42, viewed in the longitudinal direction of the resting element 32. Through this positioning of the holes 40, it is in particular possible to take into account a number of actually diverging design targets: on the one hand, a particularly favorable guidance of sound in the resting element 32 is possible and, on the other hand, the structural integrity of the resting element 32 itself can be maintained particularly stable, in view of the weakening caused by the holes 40.

The main holes 42 are chosen of equal size among each other, as well as the secondary holes 44 among each other. Furthermore, the hole area of the individual main holes 42 amounts to approximately four times the hole area of the individual secondary holes 44, i.e. the hole size, defined for example by the inside width of a hole 40, of the main holes 42 is approximately double the hole size of the secondary holes 44. With this choice of geometry, one achieves that the cross-sectional share filled by the wooden material in the region of the main holes 42, viewed over the width of the resting element 32, is approximately equal to that in the region of the secondary holes 44, which leads to particularly good sound-conduction properties, viewed in the longitudinal direction of the resting element 32. In the exemplary embodiment, the holes 40 take up altogether an area of approx, 12.5% of the area of the resting element 32. It has turned out that in general, relatively small holes 40 tend to give a rather attenuated tone, whereas relatively larger holes 40 tend to give a rather open tone, so that the chosen hole size, and thus also their area share in the overall area of the resting element 32, can suitably be chosen also in view of the desired sound behavior and possibly also in view of the material (wood) intended for use.

Furthermore, the holes 40 have sharp edges, because in comparison with holes with rounded edges, a particularly pleasant sound pattern can be achieved in this way.

Figure 6A:
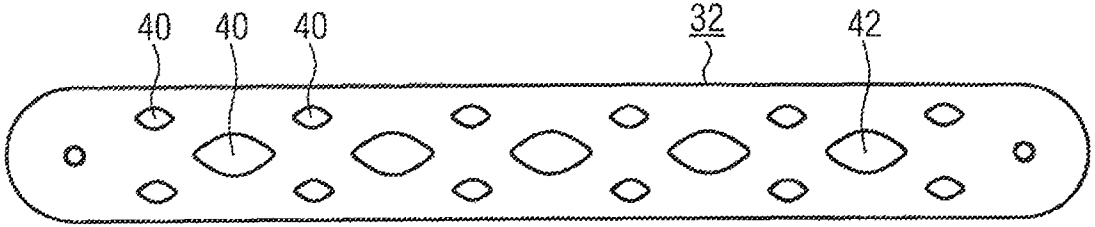
FIGS. 6*a-c* are each top views of the base of a resting element of the shoulder rest of FIG. 5.
Figure 6B:
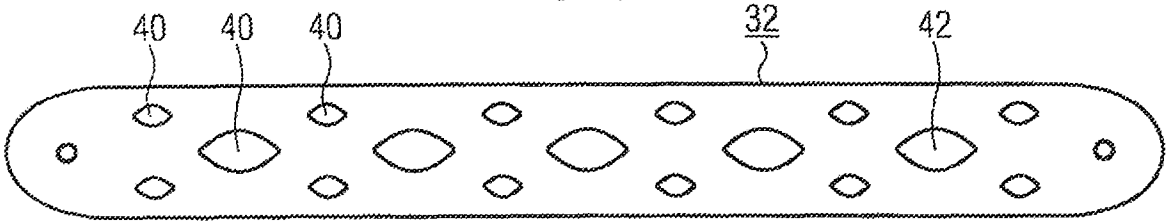
Figure 6C:
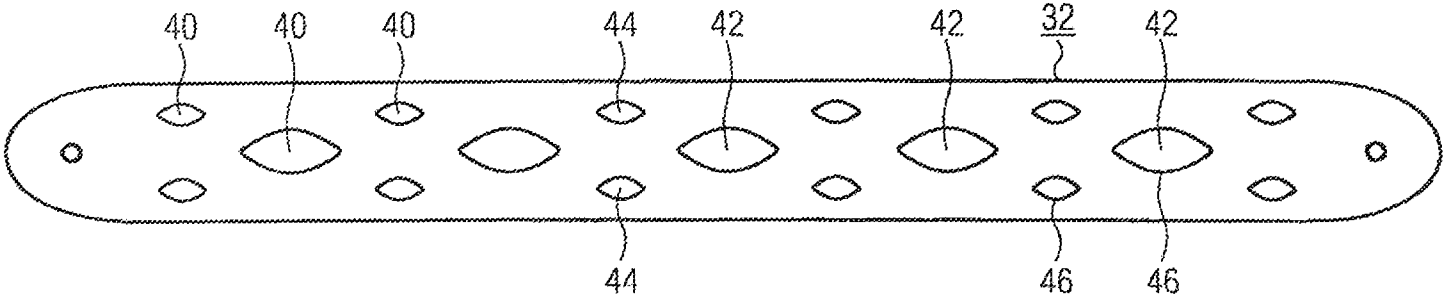

FIG. 6*a-c* show top views of the base 34 of the resting element 32 of the shoulder rest 38 in three different exemplary size variants. For an independent configuration of the shoulder rest 38, i.e. when it is used directly in combination with the instrument to be played, the following parameter combinations are provided with regard to their dimensioning:

- for a shoulder rest to be used with a separate adapter piece ("cradle") or for a shoulder rest for a 3/4 violin (represented in FIG. 6*a*): thickness 4 mm, length 205 mm, width 25 mm, mean compression 17 to 20%,
- for a shoulder rest for a 4/4 violin (represented in FIG. 6*b*): thickness 4.5 mm, length 221 mm, width 25 mm, mean compression 17 to 20%,
- for a shoulder rest for a 4/4 viola (represented in FIG. 6*c*): thickness 5 mm, length 274 mm, width 28 mm, mean compression 17 to 20%.

It can be seen particularly clearly in the top views of FIG. 6 that the holes 40 are, in addition, not round, but contoured in an elongated configuration, viewed in the longitudinal direction of the resting element 32, so that each of them presents a larger inside width, viewed in the longitudinal direction of the resting element 32, than in the latter's cross direction. It is achieved in this way that they bring about a particularly suitable guidance of sound within the resting element 32, in which the sound waves are guided around the holes 40, which are considered as obstacles for sound propagation, in a particularly suitable and harmonious manner. The configuration of the holes 40 extending in longitudinal direction can be combined in particular with a relatively pointed contour in the region where the sound waves impact, so that the sound waves can be guided around the holes 40 in a particularly disturbance-free and loss-free manner.

The back of the resting element 32, i.e. the side intended to rest on the player's shoulder, can be provided with a buffer element made from a relatively resilient or soft material, for example a rubber buffer or the like. This buffer element may also include holes, which preferably correspond to the holes 40 and are arranged in a position and with a dimensioning matching them. In this way, the composite body consisting of the resting element and the buffer element presents holes passing completely through, which ensure a particular good tonal quality of the composite body, too.

Figure 7:
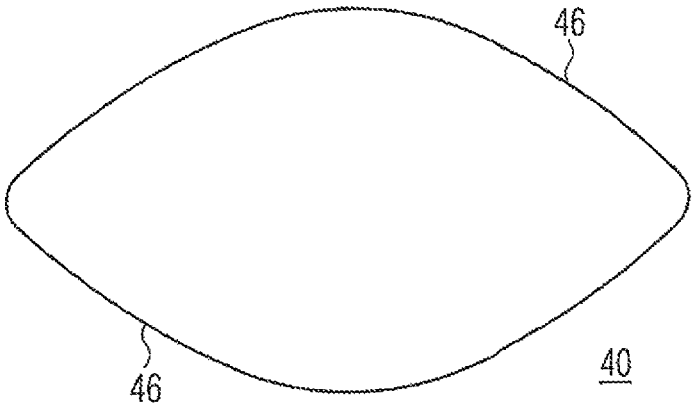
FIG. 7 shows a hole cross-section.

As can also be seen from the top view of FIG. 6 and in particular, from the top view of the contour of the holes 40 of FIG. 7, the contour of the main holes 42, just like that of the secondary holes 44, comprises a number of contour segments 46, which extend almost in a straight line, but, nevertheless, with a relatively slight uniform bending, so that the holes 40 have a substantially diamond or eye-shaped basic shape. The ratio between the longitudinal inside width and the transverse inside width of the holes 40 may vary, in particular as a function of the geometry parameters of the shoulder rest as a whole, such as, for example, the latter's overall length and/or overall width.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed is:

1. A shoulder rest for a stringed instrument, comprising a resting element configured to rest on a shoulder or chest of a player, said resting element having a base made of compressed wood, wherein the compressed wood forming the base has a mean compression of approx. 15% to approx. 25%.

2. A shoulder rest for a stringed instrument, comprising a resting element configured to rest on a shoulder or chest of a player, said resting element having a base made of compressed wood, wherein the compressed wood forming the base has a mean compression of approx. 17% to approx. 20%.

3. The shoulder rest of claim 1, wherein the compressed wood forming the base has a density of 0.6 g/cm$^3$ to 0.96 g/cm$^3$.

4. The shoulder rest of claim 1, wherein the compressed wood forming the base has a density of approx. 0.72 g/cm$^3$.

5. The shoulder rest of claim 1, wherein the base of the resting element has a cross-sectional area of at least 60 mm$^2$ in relation to a longitudinal direction of the resting element, preferably of at least 75 mm$^2$, and at most 210 mm$^2$, preferably of 150 mm$^2$.

6. The shoulder rest of claim 1, wherein the base of the resting element has a thickness of at least 2 mm and at most 7 mm, preferably of at least 3 mm and at most 6 mm, particularly preferably of at least 3.3 mm and at most 5 mm.

7. The shoulder rest of claim 1, wherein the base of the resting element has a width of at least 20 mm and at most 40 mm.

8. The shoulder rest of claim 1, wherein the base of the resting element has a width of at least 24 mm and at most 30 mm.

9. A shoulder rest for a stringed instrument, comprising a resting element configured to rest on a shoulder or chest of a player, said resting element having a base made of compressed wood, wherein the base of the resting element is formed by a workpiece cut from a block of compressed wood having a cross direction which is substantially normal to a fiber orientation of the block of compressed wood.

10. A shoulder rest for a stringed instrument, comprising a resting element configured to rest on a shoulder or chest of a player, said resting element having a base made of compressed wood, wherein the resting element has a width and is provided with a plurality of holes defining main holes and secondary holes, with the main holes arranged centrally in the resting element in relation to the width of the resting element, and with the secondary holes being arranged eccentrically in the resting element in relation to the width of the resting element, each of the secondary holes being arranged approximately in the middle between two adjacent ones of the main holes as viewed in a longitudinal direction of the resting element.

11. The shoulder rest of claim 10, wherein the main holes are of equal size.

12. The shoulder rest of claim 10, wherein the secondary holes are of equal size.

13. The shoulder rest of claim 10, wherein the main holes have a hole area which is approximately four times a hole area of the secondary holes.

14. The shoulder rest of claim 10, wherein the holes are sized to cover an area of at least 11%, preferably of at least 11%, and at most 30%, preferably of at most 20%, of an area of the resting element.

15. The shoulder rest of claim 10, wherein each of the holes has an inside width which is greater, as viewed in the longitudinal direction of the resting element, than a cross direction of the hole.

16. The shoulder rest of claim 10, wherein the main holes have a contour which includes a number of bent contour segments.

17. The shoulder rest of claim 10, wherein the main holes are provided at a number which is odd.

18. The shoulder rest of claim 17, wherein the number is five.

19. A shoulder rest for a stringed instrument, comprising a resting element configured to rest on a shoulder or chest of a player, said resting element having a width and provided with a plurality of holes defining main holes and secondary holes, with the main holes arranged centrally in the resting element in relation to the width of the resting element, and with the secondary holes being arranged eccentrically in the resting element in relation to the width of the resting element, each of the secondary holes being arranged approximately in the middle between two adjacent ones of the main holes as viewed in a longitudinal direction of the resting element.

* * * * *